US005188330A

United States Patent [19]

Curtis, Jr.

[11] Patent Number: 5,188,330

[45] Date of Patent: Feb. 23, 1993

[54] PLANT SUPPORT STRUCTURE

[76] Inventor: Grant B. Curtis, Jr., 1566 Brianwood Rd., Decatur, Ga. 30033

[21] Appl. No.: 725,503

[22] Filed: Jul. 3, 1991

[51] Int. Cl.[5] ..... F16M 13.00

[52] U.S. Cl. ..... 248/519; 47/40.5

[58] Field of Search ..... 248/511, 519, 520, 523, 248/524, 529; 47/40.5, 39

[56] References Cited

U.S. PATENT DOCUMENTS

| | | | |
|---|---|---|---|
| 96,745 | 11/1869 | Twamley | 248/524 X |
| 2,029,281 | 1/1936 | McCann | 248/524 X |
| 2,731,223 | 1/1956 | Riccio | 248/539 X |
| 3,437,296 | 4/1969 | Hinz | 47/40.5 X |
| 4,079,907 | 3/1978 | Mykleby | 248/346 X |
| 4,307,540 | 12/1981 | Reisner | 47/40.5 |
| 4,381,621 | 5/1983 | Eby | 47/40.5 |
| 4,518,164 | 5/1985 | Hayford | 248/346 X |

FOREIGN PATENT DOCUMENTS

| | | | |
|---|---|---|---|
| 601353 | 7/1960 | Canada | 248/524 |

*Primary Examiner*—J. Franklin Foss

*Attorney, Agent, or Firm*—B. J. Powell

[57] ABSTRACT

A plant support structure including a base support, an elongate staff member, a trunk attachment arrangement for releasably and flexibly connecting the projecting of said staff member to the trunk of the plant, and a mounting block for mounting the staff member on the base support so that the longitudinal axis of the angles inwardly over the base support for attachment to the plant above its center of mass to stabilize the plant.

11 Claims, 4 Drawing Sheets

PLANT SUPPORT STRUCTURE

BACKGROUND OF THE INVENTION

This invention relates generally to plant supporting structures and more particularly to stands for supporting and displaying plants such as Christmas trees.

Stands for supporting and displaying Christmas trees have been available for many years. Examples of such prior art Christmas tree stands are illustrated in:

| U.S. Pat. No. | Inventor | Issue Date |
|---|---|---|
| 4,569,151 | Hoffbeck | February 11, 1986 |
| 4,381,621 | Eby | May 3, 1983 |
| 4,307,540 | Reisner | December 29, 1981 |
| 3,119,585 | Austenson | January 28, 1964 |
| 2,904,292 | Cloutheir | September 15, 1959 |
| 2,502,040 | Franklin | March 28, 1950 |
| 2,617,617 | Krastel et al. | November 11, 1952 |
| 2,455,404 | Brown et al. | December 7, 1948 |
| 1,463,734 | Ullrich | July 31, 1923 |

One type of tree stand, examples of which are disclosed in U.S. Pat. Nos. 2,455,404; 2,502,040 and 2,617,617 engage the tree trunk relatively close to the butt of the tree which is substantially below the center of mass of the tree. Moreover, the support area of the base on which the tree is carried is relatively small as compared to the diameter of the foliage of the tree. Such an arrangement is inherently unstable resulting the tree being easily tipped over. This condition may be further aggravated by the trunk having grown crooked or by foliage that is not distributed evenly about the trunk. Also, the branches adjacent the lower end of the tree usually had to be removed to provide the necessary clear area of the trunk to be engaged by the tree stand.

Other types of stands have extended the point of attachment of the stand to the up the tree trunk by extending one or more support members up from the base immediately adjacent the tree trunk. Such stands are shown in U.S. Pat. Nos. 1,463,734 and 3,119,585. The location of the support members made it difficult to find locations adjacent the tree trunk through the branches for the support members to pass without adversely affecting the overall shape of the tree.

Another type of stand, such as those shown in U.S. Pat. Nos. 2,904,292; 4,307,540 and 4,381,621, uses a support member which is displaced horizontally from the trunk of the tree and attached to the tree trunk through a horizontal member. Under the influence of the tree weight acting on the tree, the tree may tend to rotate about the vertical member toward a less stable condition. Also, where the trunk attaching means is attached rigidly about the trunk the ability of the tree to reach a point of free body equilibrium of the forces acting through its center of mass is prevented.

SUMMARY OF THE INVENTION

These and other problems and disadvantages associated with the prior art are overcome by the invention disclosed herein by providing a plant support structure that supports the plant at its lower butt end on a support surface and engages the plant above the center of mass to laterally hold the plant against tipping. By engaging the plant above its center of mass, the weight of the plant stabilizes the free body equilibrium of the plant rather than destabilizing it as with the prior art. Further the invention has a support whose longitudinal axis passes through the point of engagement between the tree trunk and the support so that movement of the tree trunk about the point of engagement does not significantly affect the stability of the stand and tree.

The design of the invention is such that it does not require the removal of limbs to allow attachment or mounting of the stand, that the stand is easily and conveniently stored and that the stand can support cut live trees, burlap balled live trees and artificial trees.

The apparatus of the invention includes a support base for supporting a plant at its base or butt end on a support surface and a support arrangement fixedly located with respect to the support surface and extending to a prescribed height above the support surface. The support arrangement selectively engages the plant above the center of mass of the plant so that the weight of the plant tends to move the plant toward a move stable condition with respect to the support base and arrangement and the force moment on the plant is minimized. The support arrangement includes a staff member that is mounted on the base so that its axis extends through the point of engagement with the tree trunk and a flexible strap is used to secure the tree trunk to the upper end of the staff member. The support base has a multi-section construction so that it can be disassembled for stowing.

These and other features and advantages of the invention will become more clearly understood upon consideration of the following detailed description and accompanying drawings wherein like characters of reference designate corresponding parts throughout the several views and in which:

These figures and the following detailed description disclose specific embodiments of the invention, however, it is to be understood that the inventive concept is not limited thereto since it may be embodied in other forms.

DETAILED DESCRIPTION OF ILLUSTRATIVE EMBODIMENTS

Figure 1:
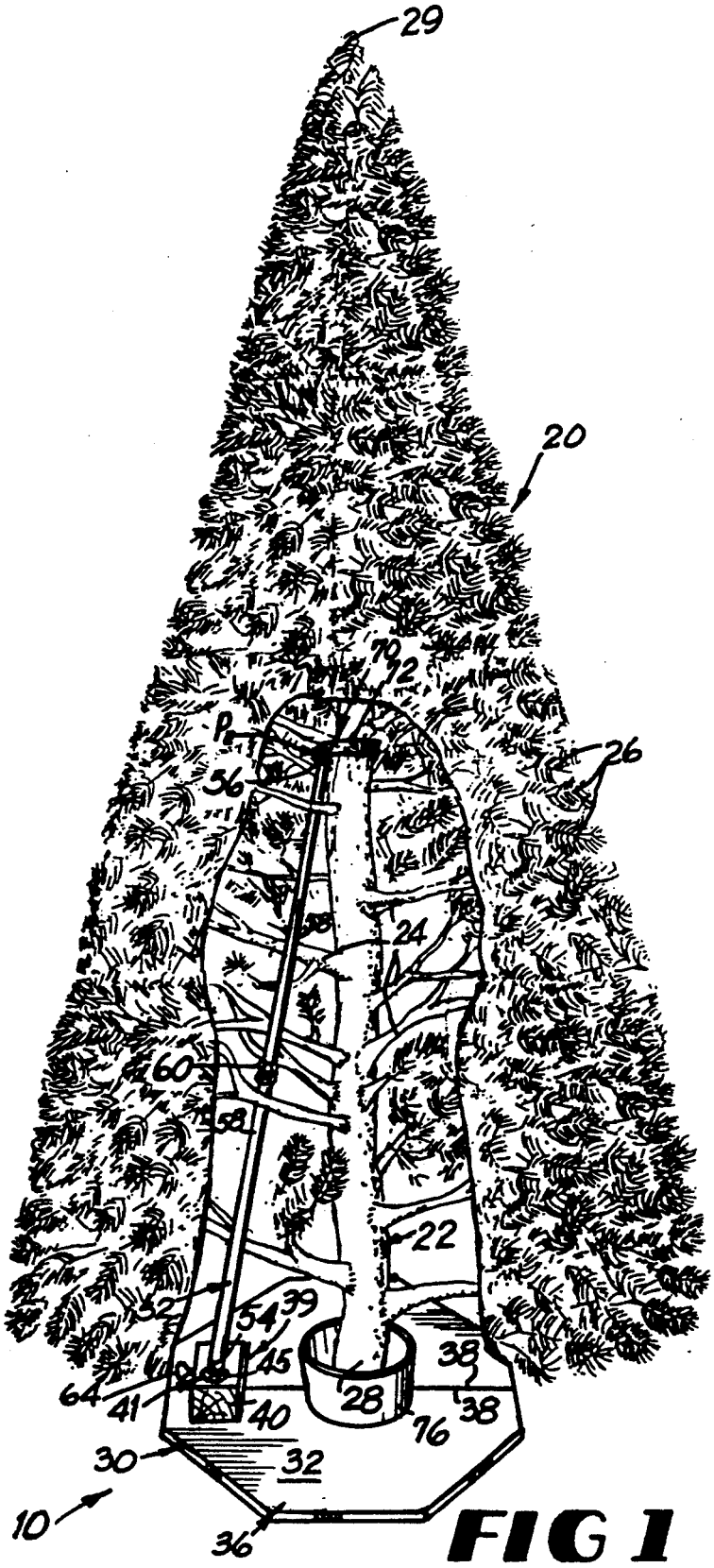
FIG. 1 is a perspective view illustrating the invention in use.
Figure 2:
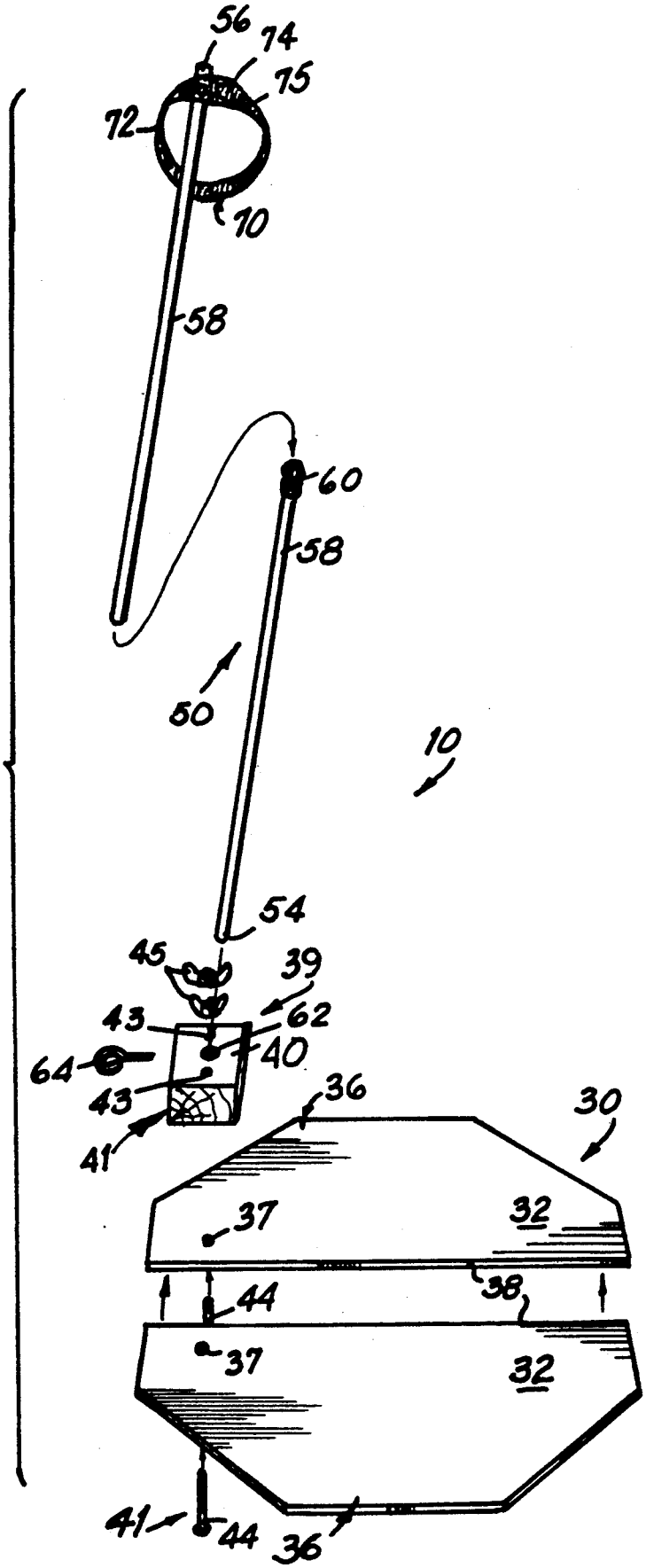
FIG. 2 is an exploded perspective view thereof.

Referring to FIG. 1, there is shown a plant support structure which is designated generally by the numeral 10. The plant support structure 10 is designed for supporting a plant such as the cut Christmas tree 20. The Christmas tree 20 includes a trunk 22, a plurality of branches 24 extending from the trunk and foliage 26 on the branches 24. The trunk 22 further includes a butt end 28 which may also be referred to as a base and a top 29.

Referring to FIGS. 1–4 the support structure includes a base 30 which defines an upper support surface 32 thereon to support the butt end 28 of the tree 20 and a lower surface 34 to engage the floor or other supporting surface on which the structure 10 sits. While it may be made as a single member or have any number of multiple subparts, the base 30 is illustrated as comprising a pair of base sections 36 which are adapted to be disposed in a coplanar relationship as seen in FIG. 1 to define the common upper support surface 32. Each base section 36 defines an elongate locating edge 38 thereon which cooperates with the like edge 38 on the other section 36 to locate the base sections 36 with respect to each other and define the common support surface 32. Each of the base sections 36 also has an appropriate base bolt hole 37 therethrough displaced from the locating edge 38 to form a triangular locating arrangement as will become more apparent to fix the sections with respect to each other when they are fitted together.

The support structure 10 further includes a bridging arrangement 39 to hold the two base sections 36 together. The arrangement 39 comprises a mounting block 40 and clamping means 41.

Figure 3:
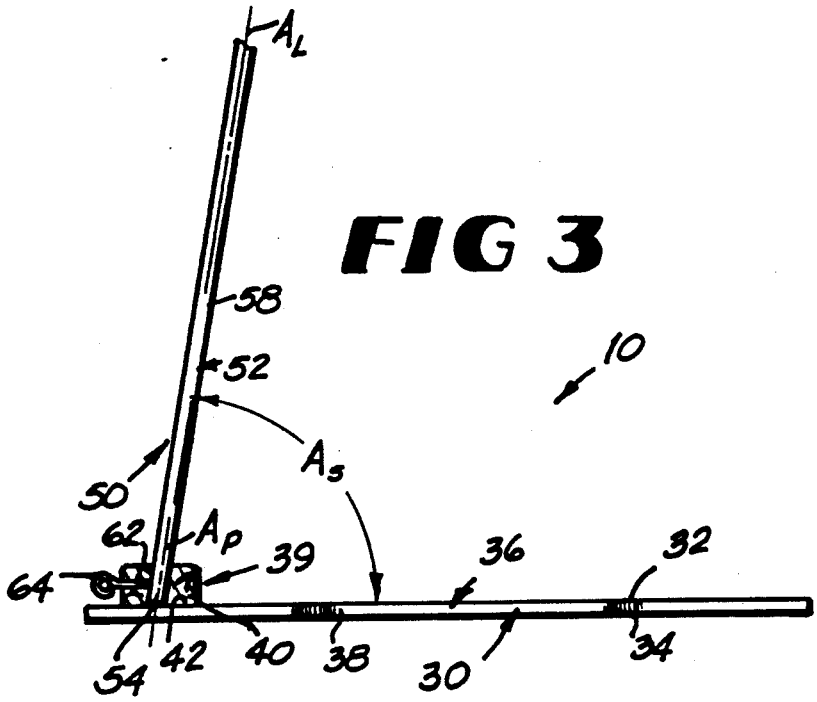
FIG. 3 is a vertical cross-sectional view thereof.
Figure 4:
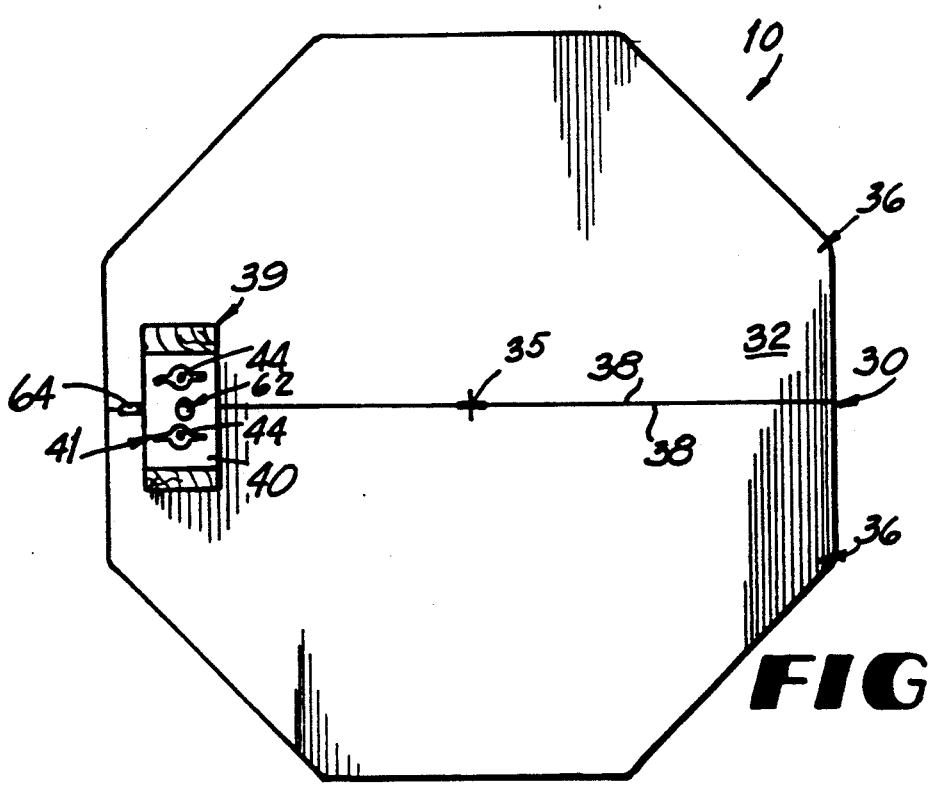
FIG. 4 is a top view thereof with the staff member removed.

The mounting block 40 defines an alignment surface 42 on the bottom thereof as best seen in FIG. 3 which is adapted to engage that portion of the upper support surface on each of the base sections 36 to maintain the base sections coplanar with the elongate locating edges 38 abutting each other when the clamping means 41 clamps the base sections 36 onto the block 40. Appropriate block bolt holes 43 are provided through the block 40 that align with the holes 37 in the base sections 36, when the base sections 36 are coplanar and the alignment edges 38 abut, through which the clamping means 41 act. The clamping means 41 may include a plurality of mounting bolts 44 which extend through the bolt holes 43 and 37 in the block 40 and the base sections 36 respectively to be secured by wing nuts 45. The triangular arrangement of the bolt holes 37 in the base sections 36 with the locating edges 38 cooperates with the block 40, bolts 44 and nuts 45 to provide an interlock for fixedly yet removably holding the base sections 36 together and coplanar with each other.

Lateral support of the Christmas tree 20 is provided by a support arrangement designated generally by the numeral 50. The support arrangement 50 includes an elongate, substantially rigid staff member 52 having a longitudinal axis $A_L$ and a predetermined length $L_1$. The staff member 52 has a lower attachment end 54 that fits into the mounting block 40 and an opposed upper projecting end 56. While it may be made of one or any number of subparts, the staff member 52 is shown in FIG. 1 as comprising two staff subsections 58 which are adapted to be fixedly yet separabably disposed in coaxial relationship by a split coupling 60. This allows the staff member 52 to be disassembled into its subsections to facilitate storage of the support structure 10 while not in use.

The staff member 52 is mounted to the base 30 by inserting the attachment end 54 into a passage 62 formed in the mounting block 40. The passage 62 is disposed in the mounting block 40 so that the staff member 52 will angle inwardly from the mounting block 40 and the projecting end 56 of the staff member 52 will be located at a position directly above the center 35 of the support surface 32 of the base 30 with an offset for trunk diameter if necessary. The support arrangement 50 may also include a locking screw 64 to lock the attachment end 54 of the staff member 52 into the mounting block 40. Thus, the passage 62 extends radially with respect to the center 35 of the surface 32 and its central axis $A_P$ defines an angle $A_S$ with respect to the surface 32 as seen in FIG. 3 is aligned with the point of engagement $P_E$ with the tree trunk 22 as will become more apparent. The particular angle $A_S$ shown is about 80° and is selected to position a staff member with a length $L_1$ of about 3.25 feet over the center 35 of the base support surface 32 with about a 2 foot diameter.

The support arrangement 50 further includes attachment means 70 on the projecting end 56 of the staff member 52 to engage the tree trunk. The attachment means 70 includes a flexible attachment member 72 mounted on the projecting end 56 of the staff member 52 for selectively connecting the tree trunk 22 to the staff member. One end of the flexible member 72 is attached to the end 56 of staff member 52 while the opposing end 74 is adapted to be wrapped around the trunk or branches of the tree 20. Any appropriate connection may be used to hold the projecting end 74 of the member 72 in place. The particular connection illustrated is a releasable hook and loop connector 75 commercially available under the trade name "Velcro." The hook portion of connector 75 is located on one side of the member 72 while the loop portion is located on the opposite side thereof to allow the member 72 to be simply looped around the tree trunk and attached to itself at any position along its length. This arrangement is such that the tree trunk can shift slightly to accommodate different sizes and shapes of the tree trunk yet this movement of the point of engagement $P_E$ with respect to the projecting end 56 of the staff 52 still maintains the longitudinal axis $A_L$ of the staff member 52 and the passage axis $A_P$ substantially passing through the point of engagement to minimize the force effect on the support arrangement 50 if the Christmas tree 20 shifts with respect to the staff member 52 or if the tree causes the staff member to rotate in the passage 62. This serves to stabilize the tree on the support structure 10.

When a cut Christmas tree is to be supported, a water container 76 is typically placed on the support surface 32 to receive the butt end of the tree 20 and supply the tree with water. It is not necessary that the container 76 be attached to the base 30 because the lateral forces exerted by the butt end 29 of the tree 20 are not sufficient to dislodge the container during use. This allows trees with misshapened trunks to be easily accommodated.

Operation

To support the tree 20 in the support structure 10, the user stands the tree on the base 30 in an upright position and shifts the tree rotationally about its central axis until the staff member 52 passes through the branches 24 to a position adjacent the trunk 22. The flexible member 72 is wrapped around the trunk 22 and attached to itself through the hook and loop connector 75. When the water container 76 is used, it is usually placed on the base 30 first and the butt end of the tree 20 set in the container 76 as it is placed on the base 30. After the attachment member 72 is connected to the tree trunk 22, the butt end of the tree trunk 22 is shifted as necessary to make the overall tree 20 vertical. Since the point of connection of the staff member 52 is offset with respect to the center of the base support surface 32, the support structure 10 can be used to support live plants in containers as well as live trees which are balled and burlaped. Of course, the structure 10 can be used to support artificial trees.

Figure 5:
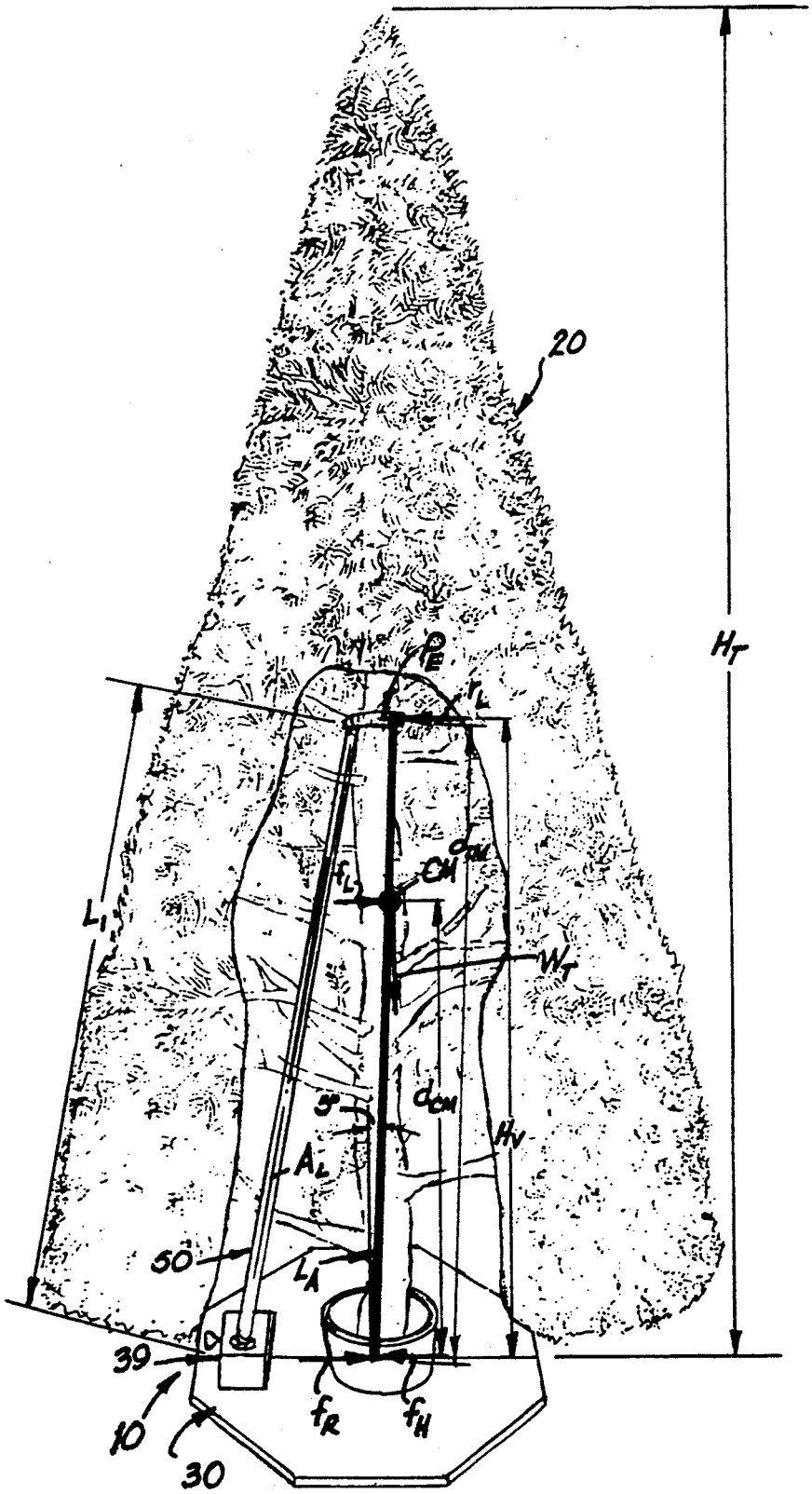
FIG. 5 is a free body diagram superimposed on the tree.

As seen in FIG. 5, the vertical height $H_V$ of the point of attachment between the projecting end 56 of the staff member 52 and the support surface 32 on the base 30 is selected to be greater than the distance between the surface 32 and the center of mass CM of the tree 20. The center of mass of cut Christmas trees is typically somewhere between 20–38% of the tree height $H_T$ as measured from the butt end of the tree. While the height $H_V$ may be varied as long as it is above the center of mass of the tree to be supported, having the height $H_V$ 40% or more of the height of the tree insures that the stability is maintained.

Since the attachment means 70 engages the tree 20 above its center of mass, the arrangement is very stable. To clarify the basis of this stability, a free body force diagram of the tree 20 is shown in FIG. 5 superimposed on the tree to indicate the forces exerted on the support structure 10 by the tree 20. The diagram is based on an eight foot tree with a slightly crooked trunk. For sake of demonstration, the center of mass CM is assumed to be at 35% of the height $H_T$ of the tree 30 as measured from the butt end 38 and the tree is assumed to have a weight of 60 pounds. The point of engagement $P_E$ between the tree trunk 22 and the attachment member 72 is assumed to be at 40% of the tree height $H_T$. The line of action $L_A$ between the butt end 28, center of mass CM, and the point of attachment $P_E$ serves as a representation of the free body diagram for the tree. The tree weight $W_T$ acts through the center of mass CM and the line of action $L_A$ is inclined 5° with respect to the vertical due to the crookedness in the tree trunk. Since the action of weight $W_T$ is located below the point of engagement $P_E$ of the attachment member 72, it always forces the butt end of the tree 20 toward the base 30. As a result, the tree and stand are less susceptible to being tipped over than prior art stands. Moreover, since the distance $d_{TM}$ of the attachment member 72 from the base support surface 32 is greater than the distance $d_{CM}$ of the center of mass CM, the lateral force exerted on the projecting end of the staff member 52 is minimized. For example, the tree 20 is trying to pivot about the butt end 28 of the tree trunk 22 on the base 30. With the line of action at 5°, the lateral component of force $f_L$ normal to the line of action $L_A$ exerted through the center of mass CM by the weight $W_T$ is about 5.2 pounds while the resistive lateral component of force $r_L$ needed at the point of attachment $P_E$ normal to the line of action $L_A$ is less than 4.6 pounds. Thus, very little force is needed to keep the tree 20 in place.

Since the line of action $L_A$ of the tree 22 is not vertically centered over the point of the engagement of the butt end of the tree trunk 22, the tree weight $W_T$ exerts a horizontal component of force $f_H$ on the butt end thereof which must be resisted by the frictional interface with the base 30. On the example illustrated in FIG. 5, the component of force $f_H$ is about 4.6 pounds. The resistive component of force $f_R$ exerted by the support surface 32 on the tree 20 is generated by the friction between the butt end of the tree and the surface 32 and the maximum force that can be generated in determined by the surface coefficient of friction. Where the surface 32 is commercially finished wood such as that available on plywood, the coefficient of friction has been found to be about 0.30–0.32 pounds per pound of vertical force exerted on the surface. Thus, where the vertical force corresponds to the weight of the tree, a possible resistive component of force $f_R$ of about 18 pounds is available. Thus, since only about 4.6 pounds is necessary to normally hold the tree in place, a comfortable margin is available to resist any tipping forces that might be inadvertently applied to the tree.

The plant support structure disclosed above provides a base 30 upon which the butt of the plant is supported and a support arrangement 50 attached to the base which provides lateral support for the plant. At times it may be desireable to provide lateral support for a plant whose butt will be or must be supported on a support surface provided by other means, for example, the ground or a floor. In this situation lateral support may be provided by an embodiment of the invention which also includes a support structure comprising an elongate substantially rigid staff member having a longitudinal axis, a projecting end which is provided with attachment means hereinbefore described and an anchoring end which is anchored to the support surface upon which the butt is supported. The relationship of the staff member, the support surface, the point of attachment of the staff member to the tree and the point of support of the butt is similar to that situation where a base is provided such that the staff member angles inwardly from the intersection point at which the anchoring end of the staff member intersects the support surface and the projecting end is located at an engagement position directly above a prescribed locating point on the support surface and spaced above the intersection point so that the longitudinal axis of the staff member passes through the point of engagement of the attachment means with the plant.

What is claimed as invention is:

1. A free standing structure for supporting a plant through its base and a point on its trunk above the center of mass of the plant on a supporting surface area, said structure comprising:

a base support adapted to rest on the supporting surface area and defining an upwardly facing support surface thereon;

an elongate substantially rigid staff member having a longitudinal axis, a prescribed length, an attachment end and an opposed projecting end;

trunk attachment means for releasably and flexibly connecting the projecting end of said staff member to the trunk of the plant while the base of the trunk is movably supported on said base support; and, staff mounting means for mounting said staff member on said base support so that the longitudinal axis of said staff member is fixedly located with respect to said upwardly facing support surface and angles inwardly from the intersection point at which said staff member intersects said support surface to an attachment position located directly above a prescribed locating position on said support surface spaced from said intersection point, said attachment located at a prescribed height above said support surface and above the center of mass of the plant so that the weight of the plant tends to move the plant toward its upright more stable condition and so that the longitudinal axis of said staff member passes substantially through the single point of attachment of said trunk attachment means with the trunk of the plant whereby the force moment around said staff member tending to destabilize the plant is minimized when the point of attachment on the plant trunk shifts around said staff member.

2. The structure of claim 1 wherein said trunk attachment means includes a flexible member attached to the projecting end of said staff member and adapted to be attached to the plant to connect the plant to the projecting end of said staff member.

3. The structure of claim 2 wherein said flexible member is an elongate member having opposed ends and where said attachment means further includes connection means operatively associated with said elongate flexible member to form a loop in said flexible member encircling said plant.

4. The structure of claim 3 wherein said connection means comprises a hook and loop connector assembly attached to said flexible member to connect said flexible member onto itself to form the loop.

5. The structure of claim 1 wherein said base support comprises a pair of base sections that fit together to define said upwardly facing support surface thereon.

6. The structure of claim 5 wherein said base support further includes interlock means for fixedly yet removably holding said pair of base sections together.

7. The structure of claim 5 wherein each of said base sections define an elongate locating edge thereon adapted to lie against said locating edge on the other base section when said base sections fit together to define said support surface thereon; and, wherein said base support further includes a bridging arrangement adapted to engage said base sections and maintain said base sections coplanar and said locating edges against each other to fixedly yet removably hold said pair of base sections together.

8. The structure of claim 7 wherein said bridging arrangement includes a mounting block defining an alignment surface thereon adapted to engage that portion of said support surface on each of said base section and maintain those portions of said support surface coplanar; and clamping means for forcing said base sections into engagement with said alignment surface.

9. The structure of claim 1 wherein said mounting means defines a passage therein adapted to removably receive said attachment end of said staff member therein, said passage defining a prescribed angle with respect to said support surface.

10. The structure of claim 8 wherein said mounting means includes said mounting block, said mounting block defining a passage therein adapted to removably receive said support means therein, said passage defining a prescribed angle with respect to said support surface when said base sections are coplanar.

11. The structure of claim 10 wherein said mounting means further includes locking means for selectively locking said staff member in said passage in said mounting block.

* * * * *